US007184567B2

(12) United States Patent
Sugata et al.

(10) Patent No.: US 7,184,567 B2
(45) Date of Patent: Feb. 27, 2007

(54) THIN SPEAKER AND METHOD OF MANUFACTURING THE SPEAKER

(75) Inventors: Hiroshi Sugata, Tokyo (JP); Hirohumi Onohara, Tokyo (JP)

(73) Assignee: Foster Electric Co., Ltd., Tokyo (JP)

( * ) Notice: Subject to any disclaimer, the term of this patent is extended or adjusted under 35 U.S.C. 154(b) by 153 days.

(21) Appl. No.: 10/505,344

(22) PCT Filed: Feb. 24, 2003

(86) PCT No.: PCT/JP03/01988

§ 371 (c)(1),
(2), (4) Date: Aug. 19, 2004

(87) PCT Pub. No.: WO03/071832

PCT Pub. Date: Aug. 28, 2003

(65) Prior Publication Data

US 2005/0201589 A1 Sep. 15, 2005

(30) Foreign Application Priority Data

Feb. 25, 2002 (JP) ..... 2002-047339

(51) Int. Cl.
*H04R 25/00* (2006.01)

(52) U.S. Cl. ..... 381/433; 381/398; 381/412; 381/416

(58) Field of Classification Search ..... 381/396, 381/398, 403, 404, 405, 407, 412, 420, 432, 381/433, 416; 181/171, 172; 335/222, 223
See application file for complete search history.

(56) References Cited

U.S. PATENT DOCUMENTS

| | | | | |
|---|---|---|---|---|
| 2,551,447 | A * | 5/1951 | Marquis | 381/416 |
| 3,250,862 | A * | 5/1966 | Rollins | 381/416 |
| 4,737,992 | A * | 4/1988 | Latham-Brown et al. | 381/404 |
| 2002/0044671 | A1 | 4/2002 | Shimomura | |

FOREIGN PATENT DOCUMENTS

| | | |
|---|---|---|
| JP | 05-022793 | 1/1993 |
| JP | 09-018983 | 1/1997 |
| JP | 11-252691 | 9/1999 |
| JP | 2001-231093 | 8/2001 |

* cited by examiner

*Primary Examiner*—Huyen Le
(74) *Attorney, Agent, or Firm*—Lynn & Lynn

(57) ABSTRACT

A thin speaker having a magnetic circuit (2) disposed at the front of a cone-like diaphragm, wherein an internal magnetic type magnetic circuit (2) and a vibration system are supported by a sufficiently strong frame formed of two pieces having an outline of generally disk-shape and partly overlapped concentrically with each other, the acoustic characteristics are prevented from being deteriorated by preventing support bodies (7, 7A) for the magnetic circuit (2) from covering the forward of the sound emitting face of the cone-like diaphragm (3), and speaker component parts are formed so as to be assembled by stacking on one jig (1) from one direction with a specified procedure, whereby an assemblability can be improved.

1 Claim, 7 Drawing Sheets

Fig. 2a
(a)
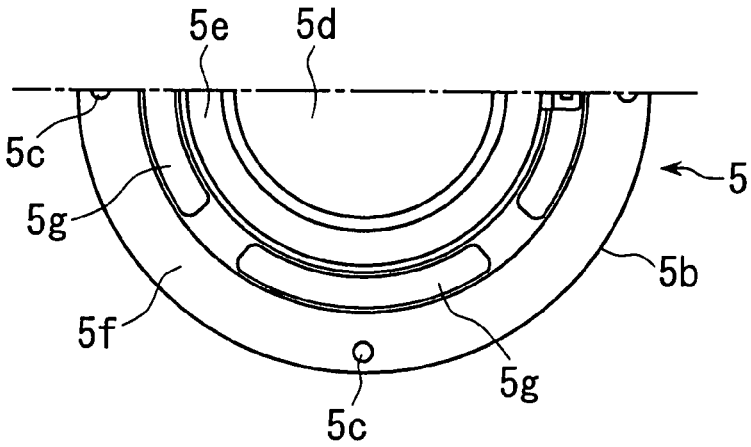
(b)
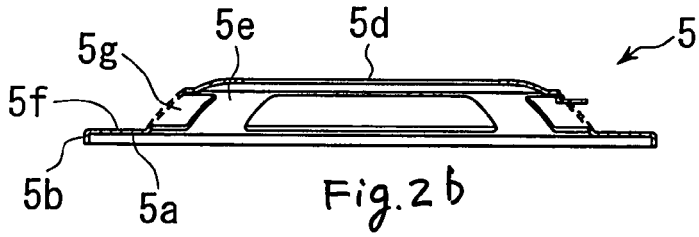
Fig. 2b
(c)
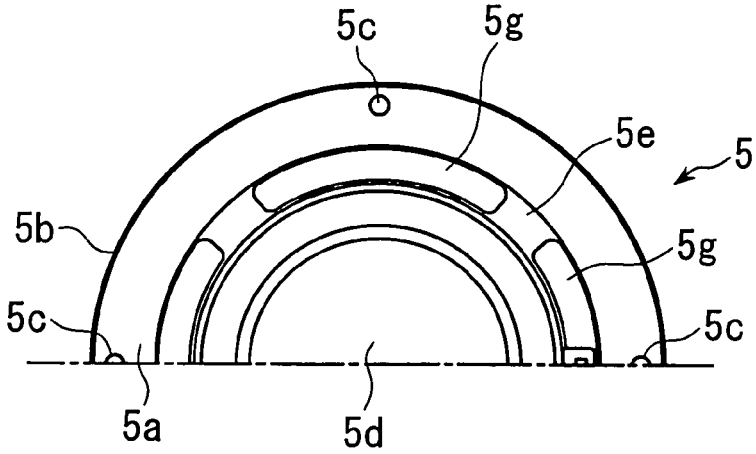
Fig. 2c

Fig. 3a
(a)
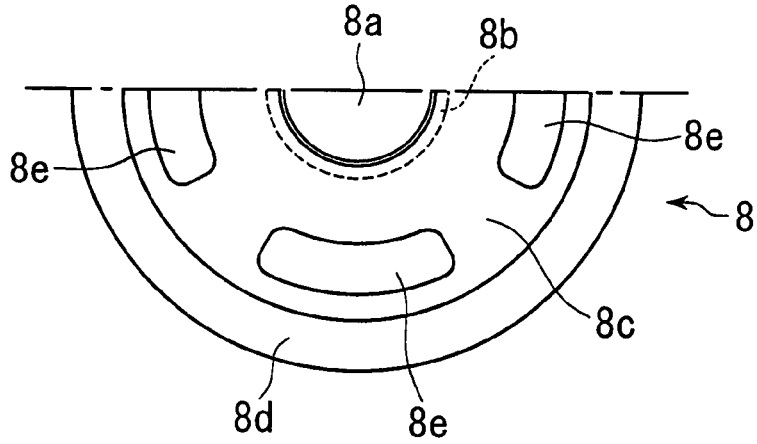
(b)
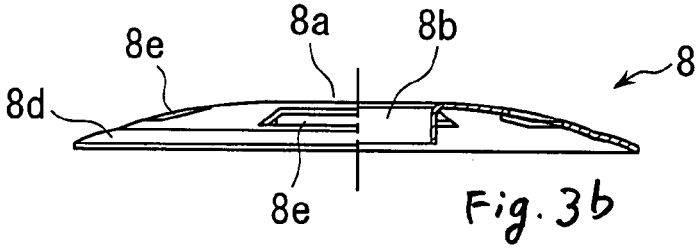
Fig. 3b
(c)
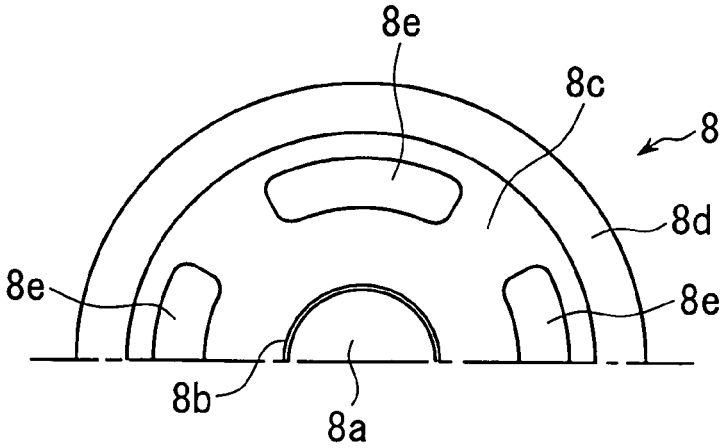
Fig. 3c

THIN SPEAKER AND METHOD OF MANUFACTURING THE SPEAKER

TECHNICAL FIELD

This invention relates to thin speakers in which the thinning of a speaker as a whole is attempted by disposing its magnetic circuit on the front side of a cone-shaped diaphragm, and to a method of manufacturing such speakers.

BACKGROUND ART

In the speakers, such as in-vehicle speakers, which are employed under conditions of limited spaces for disposition, thinning the speakers is necessarily required for responding to the requirement for space reduction.

For the response thereto, there have been suggested various measures for rendering the speakers thinner in their entire dimensions with an inner-magnet type magnetic circuit disposed in a space in front of the cone-shaped diaphragm, so that any parts of the magnetic circuit will not project rearward of the speaker.

As an example of prior art references attempting the thinning of speakers, there has been, for example, a Japanese Patent No. 2,685,175. FIG. 7 shows a sectioned view of the speaker disclosed therein.

In this speaker, the thinning of the speaker is accomplished by placing a magnetic circuit 20, diaphragm 21 and so on between a basket 22 disposed on the front side and a basket 23 disposed on the rear side, the baskets thus being in a paired front-and-rear arrangement in which the magnetic circuit 20 is supported by the front basket 22 and a vibration system is supported by the rear basket 23, and by enclosing the vibration system comprising the magnetic circuit 20, diaphragm 21, and so on, between these front and rear baskets 22 and 23.

However, in this prior art, there has been a problem that, because the magnetic circuit 20 is supported by the front basket 22 and the cone-shaped diaphragm 21 is provided on the rear side thereof, the front side of the sound radiating surface of the cone-shaped diaphragm 21 is covered by the front basket 22, which gives a bad influence on the acoustic characteristics.

As examples of the prior art references which have solved this problem, there are Japanese Utility Model Registration Nos. 2,579,525 and 3,001,527. FIG. 8 shows the speaker of the former, and FIG. 9 shows the speaker of the latter.

In these speakers, there is adopted a configuration in which the magnetic circuit 30 is supported by a supporting body 31 on the rear side of the diaphragm.

Consequently, there exists no hindrance against the sound on the front side of the sound radiating surface of the diaphragm 32, resulting in preventing damaging or degrading the acoustic characteristics.

However, in any of the above-described configurations, because there is no application of an ordinary assembling method in which the inner circumferential surface of the voice coil 33 is controlled by means of a gap gauge to position and mount the voice coil 33 in the magnetic gap, there is a problem that the assembling in high precision cannot be attained and such troubles as rubbing action of the voice coil and so on is apt to occur.

Further, there is some disadvantage in the aspect of the strength because of the unitary structure of the frame.

The present invention has been suggested in order to solve the foregoing problems, and its object is to provide a thin speaker and a method of manufacturing the speaker, wherein the thin speaker having an inner-magnetic type magnetic circuit disposed on the front side of a cone-shaped diaphragm can be obtained without provoking any degradation of the acoustic characteristics, and highly-precise assembling can be realized through simpler steps without causing any rubbing of the voice coil and so on, but with sufficient strength obtained.

DISCLOSURE OF INVENTION

In order to solve the above problems, the thin speaker of the present invention is characterized in that a frame is made to be of a two-piece structure with an upper frame 5 and a bottom frame 8 disposed behind thereof concentrically and joined with their part overlapping, wherein the upper frame 5 is supporting a vibration system including a cone-shaped diaphragm 3 having an edge 4 at an outer periphery, a voice coil 6 coupled to a neck part of the diaphragm 3, a damper 9 supporting the voice coil 6 and so on, a central part of the bottom frame 8 is supporting a supporting member 7, 7A for a magnetic circuit 2 in a magnetic gap of which the voice coil 6 is disposed, and the supporting member 7, 7A is positioned in the neck part of the diaphragm 3.

Further, the thin speaker of the present invention is characterized in that the outer peripheral part of the edge 4 is supported by an outer peripheral part of the upper frame 5, and the outer peripheral part of the damper 9 is supported at an outer periphery of a hole 5*d* formed in the center part of the upper frame 5.

Further, the thin speaker of the present invention is characterized in being assembled by putting a magnetic circuit 2 on a central part of a first jig 1, mounting a short columnar supporting member 7 for supporting the magnetic circuit 2 to an upper part thereof, disposing a substantially cylindrical voice-coil-positioning second jig 12 around the supporting member 7, disposing a voice coil 6 through the second jig 12 at a right position in a magnetic gap of the inner-magnetic type magnetic circuit 2, mounting a neck part of a cone-shaped diaphragm 3 to an outer periphery of the voice coil 6, having an edge 4 at an outer peripheral part of the cone-shaped diaphragm 3 be supported by an outer peripheral part of an upper frame 5 which is put on or over a rear side of the diaphragm 3 and is formed with a hole 5*d* in a central part, assembling a damper 9 from a rear thereof, mounting an inner periphery thereof to the outer periphery of the voice coil 6 as well as having an outer peripheral part be supported by a part around the periphery of the hole 5*d* of the upper frame 5, pulling the second jig 12 out of the hole 5*d*, disposing the bottom frame 8 from the rear side thereof, and having the bottom frame 8 support the supporting member of the magnetic circuit 2.

Further, the thin speaker of the present invention is characterized in being assembled by putting a magnetic circuit 2 on a central part of a first jig 1, disposing a substantially cylindrical voice-coil-positioning second jig 12 around a short columnar supporting member 7A provided on an upper part of the magnetic circuit 2, disposing a voice coil 6 through the second jig 12 at a right position in a magnetic gap of the magnetic circuit 2, attaching a neck part of a cone-shaped diaphragm 3 to an outer periphery of the voice coil 6, having an edge 4 at an outer peripheral part of the cone-shaped diaphragm 3 be supported by an outer peripheral part of an upper frame which is put on or over the rear side of the diaphragm 3 and is formed with a hole 5*d* in a central part, assembling a damper 9 from the rear thereof, attaching an inner periphery thereof to the outer periphery of the voice coil 6 as well as having an outer peripheral part be supported by a part around the periphery of the hole 5*d* of the upper frame 5, pulling the second jig 12 out of the hole 5*d*, disposing the bottom frame 8 from the rear side thereof, and having the bottom frame 8 support the supporting member of the magnetic circuit 2.

BRIEF DESCRIPTION OF DRAWINGS

In FIG. 2, (a) shows a plan view of one half of an upper frame employed in the present invention, (b) shows a side view thereof, and (c) shows a bottom view of the half thereof.

In FIG. 3, (a) shows a plan view of one half of a bottom frame employed in the present invention, (b) shows a side view thereof, and (c) shows a bottom view of the half thereof.

THE BEST MODE FOR CARRYING OUT THE INVENTION

Figure 1:
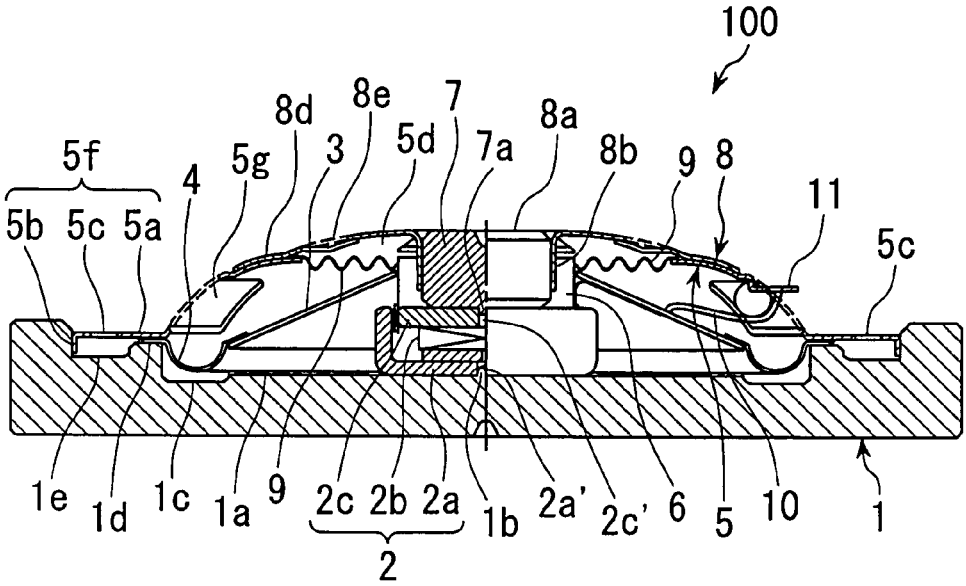
FIG. 1 is a sectional view showing the internal structure of a thin speaker relating to a first embodiment of the present invention.

A thin speaker of the present invention is made to be of a structure where an upper frame 5 and a bottom frame 8 are disposed in front and rear and the frame is made to be of a firm dual structure in which the front upper frame 5 is made to support a vibration system, while the rear bottom frame 8 side is made to support an supporting member for a magnetic circuit 2, and the supporting member 7, 7A for the magnetic circuit 2 is positioned in the neck part of a diaphragm 3, so as not to obstruct the sound radiation.

Further, it is made possible to assemble each component by sequentially assembling them in one direction.

In the followings, the embodiments of the present invention are explained in detail with reference to the drawings.

FIGS. 1 to 5 are a structural view of the thin speaker in a first embodiment of the present invention and explanatory views showing its assembling state.

First, an example of the arrangements of a thin speaker relating to a first embodiment of the present invention shall be explained with reference to FIGS. 1, 2(*a*)–(*c*) and 3(*a*)–(*c*).

FIG. 1 shows a speaker 100 assembled on and through a first jig 1 for the assembling. That is, the first jig 1 is formed in the inner surface thereof with a substantially circular flat part 1*a*, and in the central part of this flat part 1*a* there is formed a projection 1*b* for positioning and mounting an inner-magnetic type magnetic circuit 2. Further, a ring-shaped recess 1*c* is formed along the outer periphery of the substantially circular flat part 1*a*. This recess 1*c* is for housing an up-roll edge 4 which projects forward and one end of which is joined to the outer peripheral part of a diaphragm 3.

Along the outer periphery of the recess 1*c* there is formed an edge-part-supporting portion 1*d* formed to be a platform part formed as a projection. Along the outer periphery of this supporting portion 1*d*, there is formed a supporting part 1*e* for an edge-supporting-and-mounting portion 5*a* formed in a flange-shape along the outer periphery of a concave type upper frame 5. At the outer periphery of the edge supporting and mounting portion 5*a* of the upper frame 5 there is formed a bent part 5*b* formed as bent substantially into an L-shape, and this bent part 5*b* is abutted and fixed to the circumferential surface positioned at the outer side of the recess-like upper-frame-supporting part 1*e*. The edge supporting and mounting portion 5*a* is formed with a mounting hole 5*c* for mounting the speaker.

The magnetic circuit 2 to be placed on and fixed to the center part of the inner surface of the first jig 1 has a yoke 2*a* comprising a circular disk part and an outer peripheral wall formed along the outer periphery of the disk part, a short columnar magnet 2*b* provided on the inner surface of the yoke 2*a*, and a disk-shaped plate 2*c* provided on the upper part of the magnet 2*b*, wherein a magnetic gap is formed between the outer periphery of the plate 2*c* and the inner circumferential surface of the yoke 2*a*. Further, a positioning recess 2*a*' corresponding to and engageable with the projection 1*b* of the first jig 1 is formed in the center of the outer surface of the yoke 2*a*.

The magnetic circuit 2 comprises an inner-magnet type magnetic circuit, in the magnetic gap of which one end part of a cylindrical voice coil 6 is positioned, while the neck part of the cone-shaped diaphragm 3 is coupled to the outer periphery of the upper part in the other end part of the voice coil 6. The outer periphery of this diaphragm 3 is mounted through the edge 4 to the edge supporting and mounting portion 5*a* of the upper frame 5.

A supporting member 7 comprising a short, substantially columnar adapter is placed and fixed onto the plate 2*c* of the magnetic circuit 2. A positioning projection 7*a* is formed in the center of the bottom part of this supporting member 7, and this projection 7*a* is engaged in a mounting hole 2*c*' formed in the center part of the plate 2*c* to mount and fix the supporting member 7 onto the magnetic circuit 2.

In the present invention, the cone-shaped diaphragm 3 which is having the voice coil 6 and to which the edge 4 was mounted and so on are supported by the substantially dish-shaped upper frame 5 disposed on the outside thereof in the illustrated state.

This upper frame 5 formed substantially in the dish shape as a whole comprises, as shown in FIGS. 2(*a*)–(*c*) in detail, a main body 5*e* formed to have a circular hole 5*d* in the central part and to be curved, and a flange part 5*f* which is at the outer periphery of the main body 5*e* and extends outwardly in the substantially horizontal direction. The main body 5*e* is formed with a plurality of oblong sound holes 5*g* with intervals in the circumferential direction, the edge mounting and supporting portion 5*a* is formed in the peripheral part of the flange part 5*f* which has at least one mounting hole 5*c*, and further along the outer periphery thereof, there is formed the L-shaped bent part 5*b* for mounting and fixing it onto the first jig 1. This bent part 5*b* also functions as a reinforcement for the flange part 5*f*.

A bottom frame 8 to support the magnetic circuit 2 is disposed on the rear side of the upper frame 5, i.e., on the top part of its outside, and partly joined with the upper frame 5.

That is, in the present invention, the frame is made to be in a two-piece structure of the upper frame 5 to support the vibration system and the bottom frame 8 which has a diameter smaller than the upper frame 5, is disposed to be concentric with the upper frame 5 on the backside thereof such that one part overlaps with and is coupled to the upper frame 5, and which is to support the magnetic circuit 2.

As shown in FIGS. 3(*a*)–(*c*) in detail, this bottom frame 8 is formed with a circular hole 8*a* in the central part and is having a main body 8*c* substantially of a small dish shape and formed with a cylindrical part 8*b* projecting forwardly at the outer circumference of the hole 8*a*, and a flange part 8*d* extending outwardly at an angle to the front from the outer periphery of the main body 8*c*.

The main body 8*c* is formed with a plurality of window-like sound holes 8*e* which are formed as mutually spaced along the circumferential direction and elongated in the circumferential direction. And, the short columnar supporting member 7 integrated with and on the magnetic circuit 2 is inserted into and fixed to the cylindrical part 8*b*. That is, the magnetic circuit 2 is supported by the bottom frame 8, and the supporting member 7 for the inner-magnet type magnetic circuit 2 is made not to cover the front side of the sound radiating surface of the cone-shaped diaphragm 3 supported by the upper frame 5, so as not to give any bad influence on the acoustic characteristics.

In here, the outer peripheral part of the cone-shaped diaphragm 3 is mounted through the edge 4 to the flange-shaped edge supporting and mounting portion 5*a* of the upper frame 5, while the neck part on the inner circumferential side of the diaphragm 3 is coupled to the outer periphery of the voice coil 6 through an adhesive agent. To this outer periphery of the voice coil 6 an inner circumferential part of a damper 9 is coupled through an adhesive agent, while an outer peripheral part of this damper 9 is coupled through an adhesive agent to the part outside of the outer periphery of the hole 5*d* in the upper frame 5.

Other than those, in FIG. 1, reference numeral 10 denotes a lead wire, one end of which is connected, on the rear side of the cone-shaped diaphragm 3, to a terminal wire of the voice coil 6. Reference numeral 11 denotes a relay terminal which is of a shape of a cut and raised piece projecting from the back surface of the upper frame 5, and the other end of the lead wire 10 is connected thereto.

Figure 4:
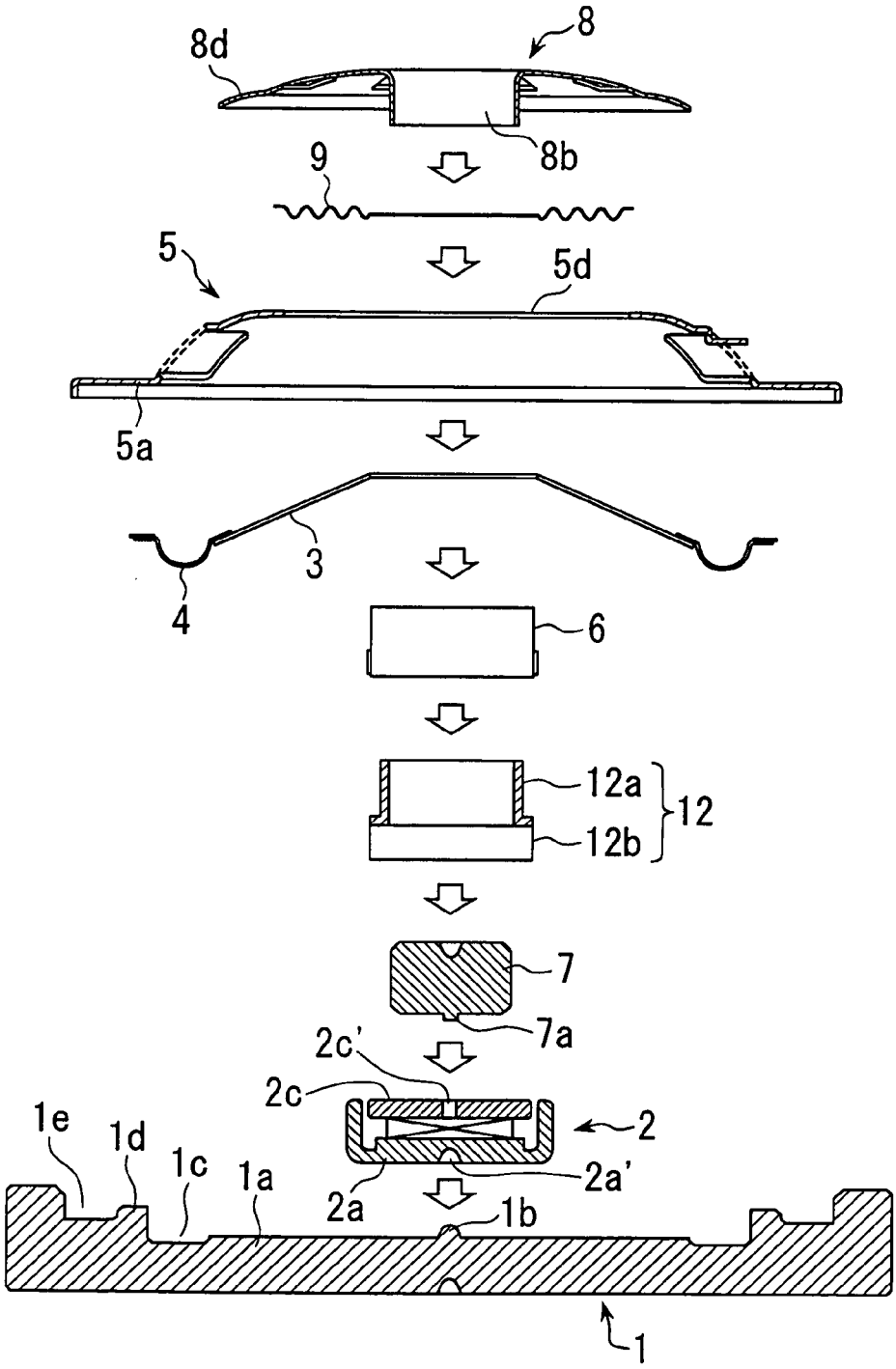
FIG. 4 shows an explanatory view for the assembling process of the thin speaker relating to the first embodiment of the present invention.

Next, an assembling method for the thin speaker of the first embodiment of the present invention shall be explained with reference to FIG. 4.

In the assembling, first, the separately pre-assembled magnetic circuit 2 is placed on the central part of the first jig 1 while the recess 2*a*' in the outer surface of the yoke 2*a* is positioned to the projection 1*b* of the first jig 1, as being shown by an arrow.

Next, the supporting member 7 is integrated with the magnetic circuit 2 through an adhesive agent, while the projection 7*a* provided at the center of the front surface of the supporting member 7 is inserted into the hole 2*c*' in the plate 2*c* of the magnetic circuit 2.

In assembling the voice coil 6, the substantially cylindrical second jig 12 is positioned on the outer periphery of the supporting member 7.

This second jig 12 is for positioning the voice coil 6, and after the second jig 12 is set at a predetermined position, the voice coil 6 is disposed on the outer periphery thereof. The second jig 12 functions as a gap gauge for controlling the inner circumference of the voice coil 6, and enables the assembling of high precision.

That is, the second jig 12 is made to have a smaller-diameter part 12*a* and, in the front thereof, a larger-diameter part 12*b*, where the outer diameter of the larger-diameter part 12*b* is made equal to the inner diameter of the voice coil 6 and a thickened part at the front end of the smaller-diameter part 12*a* is placed on the outer peripheral part of the plate 2*c*, so that the voice coil 6 can be disposed at a proper position in the magnetic gap.

After the disposition and retention of the voice coil 6, the neck part of the inner peripheral part in the cone-shaped diaphragm 3 provided with the edge 4 at the outer periphery is joined through an adhesive agent to a predetermined position on the outer peripheral part of the voice coil 6.

Further, the upper frame 5 is mounted. The outer periphery of the edge 4 is joined through an adhesive agent to the edge supporting and mounting portion 5*a* of the upper frame 5, and the upper frame 5 is placed on the first jig 1.

Next, the inner peripheral part of the damper 9 is joined through an adhesive agent to a predetermined position on the outer peripheral part of the voice coil 6, while the outer peripheral part of the damper 9 is mounted through the adhesive agent to the outer surface of the part outside of the periphery of the hole 5*d* in the upper frame 5.

As a result, the vibration system formed by the voice coil 6, damper 9, cone-shaped diaphragm 3 and so on is supported by the upper frame 5.

Thereafter, the bottom frame 8 is assembled and joined with the back side of the upper frame 5 for supporting the magnetic circuit 2, whereas the second jig 12 is pulled out through the hole 5*d* and removed before the bottom frame 8 is joined.

The adapter 7 is inserted into the cylindrical part 8*b* of the bottom frame 8, and is fixed by an adhesive agent. Also, the inner surface of the flange part 8*d* of the bottom frame 8 is put to overlap on the outer surface of the part around the periphery of the hole 5*d* in the upper frame 5, and joined and unified therewith by an adhesive agent.

After the assembling is finished and the adhesive agent at each part solidifies, the first jig 1 is removed to complete the thin speaker.

According to the present invention, the assembling can be carried out by sequentially assembling the each part in a single direction as explained above, and the assembling is made easier, able to be adapted to automation, and suitable for mass production.

Figure 5:
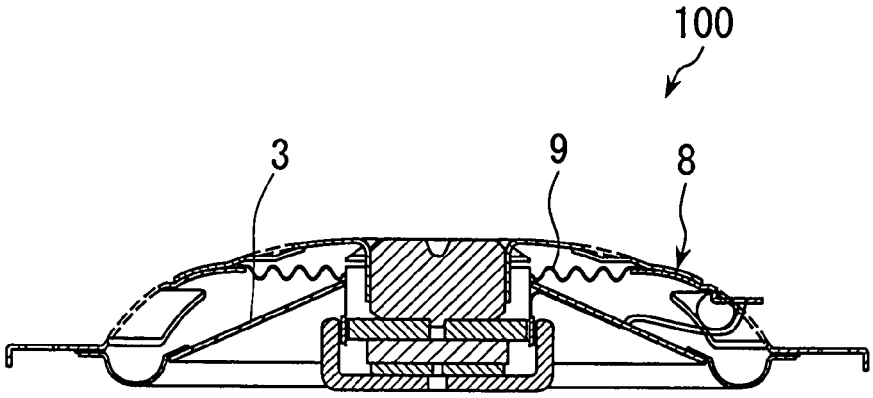
FIG. 5 shows a section of the thin speaker of the present invention as assembled.

FIG. 5 shows a sectioned view of the assembled thin speaker 100.

Figure 6:
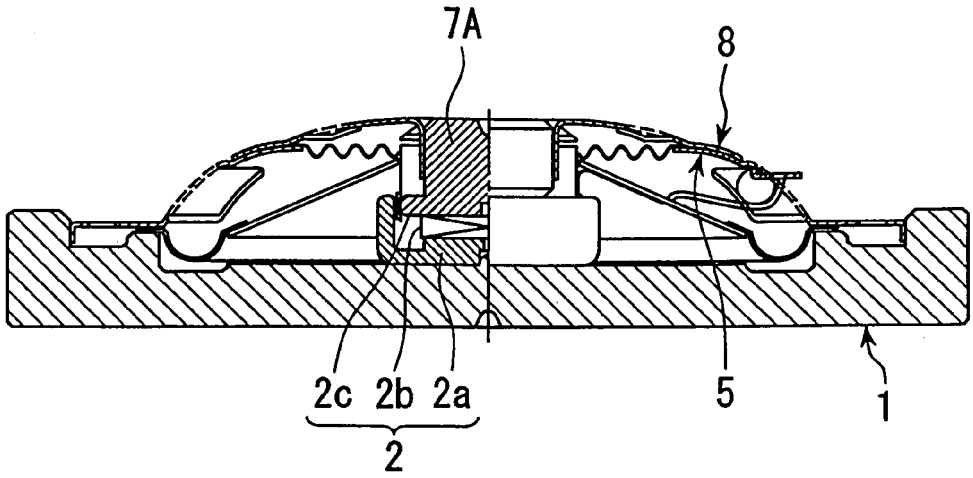
FIG. 6 shows a sectioned view showing the internal structure in a second embodiment of the present invention.
Figure 7:
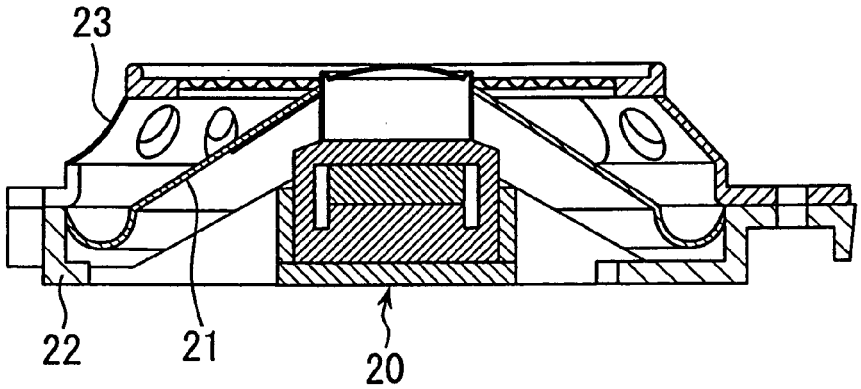
Fig. 7 PRIOR ART
FIG. 7 shows a sectioned view showing a conventional thin speaker.
Figure 8:
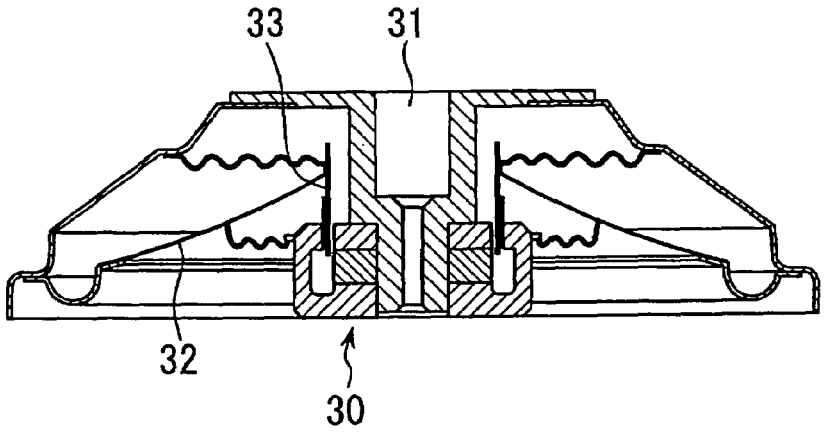
Fig. 8 PRIOR ART
FIG. 8 shows a sectioned view showing another conventional thin speaker.
Figure 9:
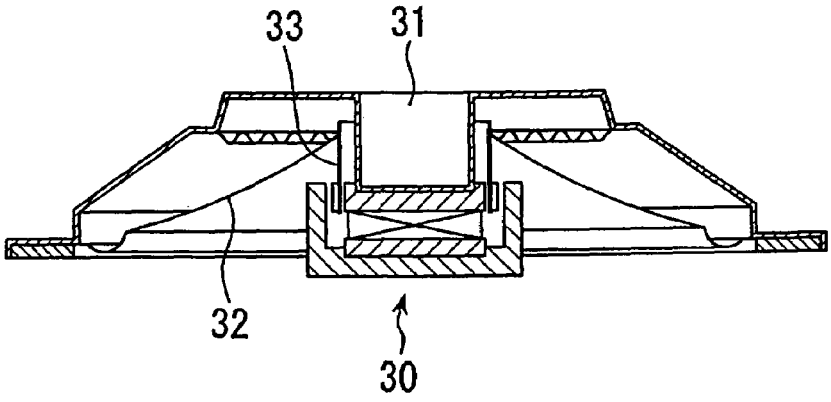
Fig. 9 PRIOR ART
FIG. 9 shows a sectioned view showing still another conventional thin speaker.

FIG. 6 is of a second embodiment of the present invention. This embodiment is characterized in that a short columnar supporting member 7A is formed integrally with the plate 2*c* of the inner-magnet type magnetic circuit 2, in an attempt to simplify the assembling.

That is, in the above-described first embodiment shown in FIG. 1 and so on, as the supporting member 7 is of a separate structure, an assembling step of the supporting member 7 is necessary in the assembling. However, in this second embodiment, because the supporting member 7A is integrally formed with the plate 2*c*, there is an advantage of being able to reduce its assembling step.

In here, as the other configuration is the same as in the first embodiment, and also the assembling process is substantially the same except for the absence of the assembling step for the supporting member, the explanation therefor shall be omitted.

By the way, the above embodiments are only for showing some examples, and various modifications can be performed without deviating from the gist of the present invention.

That is, the shape of the upper frame 5 and/or bottom frame 8 are not necessarily limited to a circular shape, and they can be, for example, of a polygonal shape. In that case, the first jig 1 can be prepared corresponding thereto. It is also possible to enlarge the shape of the bottom frame 8 to have its strength increased. Further, the edge 4 of the diaphragm 3 can be of down-roll, or, for example, of a mixture of up-rolls and down rolls. Still further, the present invention is of course applicable to an outer-magnet type magnetic circuit as the magnetic circuit 2.

INDUSTRIAL APPLICABILITY

As has been described, according to the present invention, the frame is divided into two pieces, which are combined concentrically with a part of each frame overlapping with each other's, and one of the frames supports the cone-shaped diaphragm 3, while the other frame supports the supporting member for the magnetic circuit 2, which magnetic circuit 2 is disposed to be received in the neck part of the diaphragm 3, such that the supporting member for the magnetic circuit 2 will not come over the sound radiation plane of the diaphragm 3, whereby a thin speaker with a magnetic circuit disposed on the front side of a cone-shaped diaphragm can be established without causing the acoustic characteristics to be deteriorated, and the frame supporting the magnetic circuit of large weight is made to be two layer structure of partly overlapping relationship, so as to be further improved in the strength.

Further, according to the method for manufacturing the thin speaker of the present invention, the constituent parts can be assembled by sequentially stacking them up in the predetermined order on the single jig 1, whereby the assembling is made very easy, the mutual positional relationship between the respective parts can be set based on a single standard, and the ordinary gap gauge for controlling the inner circumference can be used for positioning the voice coil 6, which enables a highly precise assembling and prevents the occurrence of the troubles such as the rubbing of the voice coil.

What is claimed is:

1. A thin speaker comprising:

a frame of a two-piece structure including a circular dish-shaped upper frame (5) having a circular center hole (5*d*), and a circular dish-shaped bottom frame (8) having a central circular hole (8*a*) and a cylindrical part (8*b*) extending inward from a peripheral edge of the circular hole (8*a*), the bottom frame (8) being disposed and coupled concentrically with respect to the upper frame (5) with an outer peripheral flange part (8*d*) of the bottom frame (8) overlapped to an outer surface of a peripheral edge part of the center hole (5*d*) of the upper frame (5);

a vibration system including a cone-shaped diaphragm (3) coupled at an elastic edge (4) at an outer periphery of the diaphragm (3) to an outer peripheral edge of the upper frame (8), a cylindrical voice coil (6) having a first end positioned in an interior space of the diaphragm (3) and having an outer periphery of a second end coupled to an inner peripheral edge of the diaphragm (3), and an annular damper (9) coupled at inner peripheral edge to an outer peripheral portion of the second end of the voice coil (6) and at an outer peripheral edge to the outer surface at the peripheral edge part of the center hole (5*d*) of the upper frame (5) for resiliently holding the inner periphery of the diaphragm (3); and a magnetic circuit (2) including a yoke (2*a*) comprised of a circular disk part and an outer peripheral wall, a short columnar magnet (2*b*) provided within the yoke, a disk-shaped shaped plate (2*c*) provided on an outer surface directed axially from the magnet (2*b*), and a short columnar supporting member (7) coupled at an end to an outer surface of the plate (2*c*) and inserted within the cylindrical part (8*b*) of the bottom frame (8), the magnetic circuit (2) forming a magnetic gap positioned in the interior space of the diaphragm (3) for receiving in the gap the other end having the voice coil (6).

* * * * *